US011466525B2

(12) United States Patent
Wessel et al.

(10) Patent No.: US 11,466,525 B2
(45) Date of Patent: Oct. 11, 2022

(54) PROPULSION UNIT FOR WELLBORE TRACTOR TOOL

(71) Applicant: Wireline Drilling Technologies, LLC, The Woodlands, TX (US)

(72) Inventors: Daniel Wessel, The Woodlands, TX (US); Michael Duckering, Conroe, TX (US)

(73) Assignee: Wireline Drilling Technologies, LLC, The Woodlands, TX (US)

( * ) Notice: Subject to any disclaimer, the term of this patent is extended or adjusted under 35 U.S.C. 154(b) by 143 days.

(21) Appl. No.: 16/041,211

(22) Filed: Jul. 20, 2018

(65) Prior Publication Data

US 2020/0024915 A1 Jan. 23, 2020

(51) Int. Cl.
*E21B 23/00* (2006.01)
*E21B 23/14* (2006.01)

(52) U.S. Cl.
CPC ..... *E21B 23/00* (2013.01); *E21B 23/001* (2020.05); *E21B 23/14* (2013.01)

(58) Field of Classification Search
CPC .... E21B 23/00; E21B 2023/008; E21B 23/08; E21B 23/001
See application file for complete search history.

(56) References Cited

U.S. PATENT DOCUMENTS 4,192,380 A * 3/1980 Smith ..... E21B 17/1021 166/104
8,316,965 B2 11/2012 Hallundbaek et al.
9,435,167 B2 9/2016 Hallundbaek
9,850,728 B2 * 12/2017 Wessel ..... E21B 17/206
2004/0154809 A1 * 8/2004 Bakke ..... E21B 23/04 166/382
2005/0145415 A1 * 7/2005 Doering ..... E21B 4/18 175/24
2005/0194187 A1 * 9/2005 Gleitman ..... E21B 7/24 175/57
2012/0012337 A1 1/2012 Hall et al.
(Continued)

FOREIGN PATENT DOCUMENTS

WO 2011/10477 A1 9/2008

OTHER PUBLICATIONS

International Search Report and Written Opinion dated Oct. 10, 2019, Application No. PCT/US19/38745.
(Continued)

*Primary Examiner* — Robert E Fuller
*Assistant Examiner* — Neel Girish Patel
(74) *Attorney, Agent, or Firm* — Richard A. Fagin

(57) ABSTRACT

A propulsion unit for a wellbore tool includes a tool body and at least one wheel section disposed along the tool body. The wheel section comprises a tractor pad movably coupled to a tractor housing coupled to the tool body. The tractor pad is movable only in a lateral direction with respect to the tool body. A wheel rotatably is supported in the tractor pad so as to contact a wall of a wellbore when the tractor pad is moved away from the tractor housing. An hydraulic motor is rotationally coupled to the wheel. The hydraulic motor comprises a displacement changing element operable to change displacement of the hydraulic motor. The unit comprises means for moving the tractor pad between an extended position and a retracted position.

10 Claims, 7 Drawing Sheets

(56) References Cited

U.S. PATENT DOCUMENTS

| | | | | |
|---|---|---|---|---|
| 2013/0180730 | A1* | 7/2013 | Bebak | E21B 43/128 166/381 |
| 2014/0013731 | A1* | 1/2014 | Hallundbæk | E21B 23/14 60/325 |
| 2014/0014367 | A1* | 1/2014 | Hallundb¬k | E21B 23/00 166/381 |
| 2014/0014368 | A1* | 1/2014 | Hallundbæk | E21B 23/00 166/381 |
| 2016/0032711 | A1* | 2/2016 | Sheiretov | E21B 45/00 73/152.54 |
| 2016/0348438 | A1* | 12/2016 | Kirkhope | E21B 47/024 |
| 2019/0316433 | A1* | 10/2019 | Schroit | H02K 9/193 |

OTHER PUBLICATIONS

Canadian Office Action dated Mar. 4, 2022, for Canadian Application No. 3,106,350.

* cited by examiner

PROPULSION UNIT FOR WELLBORE TRACTOR TOOL

CROSS REFERENCE TO RELATED APPLICATIONS

Not Applicable.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of self-propelled tools used in intervention operations in subsurface wells. More specifically, the disclosure relates to propulsion devices for such tools, called wellbore "tractors."

Wellbore tractors are known in the art for moving tools along the interior of wellbores drilled through subsurface formations where gravity or fluid movement is not available to move such tools.

U.S. Pat No. 9,435,167 issued to Hallundbæk discloses a propulsion unit for a wellbore tool. The propulsion unit comprises a driving unit housing, an arm assembly movable between a retracted position and a projecting position in relation to the driving unit housing, an arm activation assembly arranged in the driving unit housing for moving the arm assembly between the retracted position and the projecting position, and a wheel assembly for driving the driving unit forward in the well. The wheel assembly comprises a stationary part and a rotational part, the stationary part being connected with or forming part of the arm assembly and being rotatably connected with a rotational part. The wheel assembly further comprises a hydraulic motor including a hydraulic motor housing and a rotatable section connected with the rotational part for rotating part of the wheel assembly. By having a motor enclosed in a hydraulic motor housing in the wheel assembly, roller chains or caterpillar tracks can be avoided. By having a closed housing, dirt from the well fluid in which the driving unit propels itself does not get stuck in the chain or caterpillar track, destroying the function of the wheel.

There continues to be a need for improved propulsion units for wellbore tools.

SUMMARY

A propulsion unit for a wellbore tool according to one aspect of the disclosure includes a tool body and at least one wheel section disposed along the tool body. The wheel section comprises a tractor pad movably coupled to a tractor housing coupled to the tool body. The tractor pad is movable only in a lateral direction with respect to the tool body. A wheel rotatably is supported in the tractor pad so as to contact a wall of a wellbore when the tractor pad is moved away from the tractor housing. An hydraulic motor is rotationally coupled to the wheel. The hydraulic motor comprises a displacement changing element operable to change displacement of the hydraulic motor. The unit comprises means for moving the tractor pad between an extended position and a retracted position.

In some embodiments, the displacement changing element comprises at least one radially displaceable piston coupled to a rotor disposed in a cavity, the at least one radially displaceable piston operable to extend from the rotor by action of hydraulic pressure selectively applied to the at least one radially displaceable piston.

Some embodiments further comprise a pressure relief valve disposed in a hydraulic fluid supply conduit in communication with the at least one radially displaceable piston, wherein fluid communication to the at least one radially displaceable piston is open when the hydraulic pressure exceeds an operating pressure of the pressure relief valve.

Some embodiments further comprise an hydraulic pressure intensifier disposed in the hydraulic fluid supply conduit and arranged to selectively increase the hydraulic pressure to above the operating pressure.

In some embodiments, the means for moving comprises at least one fixed piston disposed on the tractor housing and extending into a cylinder formed in the tractor pad.

Some embodiments further comprise at least one guide bushing disposed in the tractor pad arranged to engage a corresponding guide pin in the tractor housing.

In some embodiments, the wellbore tool comprises a drilling system.

In some embodiments, the drilling system comprises a drilling cuttings removal system.

In some embodiments, the wellbore tool is connected to a wireline cable.

A method for moving a wellbore tool according to another aspect of the disclosure includes extending a tractor pad laterally from the wellbore tool to urge a wheel rotatably supported on the tractor pad into contact with a wall of the wellbore. Hydraulic fluid is pumpted at a first pressure into an hydraulic motor disposed in the tractor pad and rotationally coupled to the wheel. Pressure of the hydraulic fluid is increased between a position of the pumping and the hydraulic motor to a predetermined value to increase a displacement of the hydraulic motor so as to decrease a speed of the motor and increase a torque of the motor.

In some embodiments, the extending is performed only in a direction laterally outward from the wellbore tool.

In some embodiments, the increasing displacement comprises actuating at least one radially displaceable piston on a rotor of the hydraulic motor to contact a wall of a cavity in the motor.

DETAILED DESCRIPTION

U.S. Pat. No. 9,850,728 issued to Wessel discloses a wireline (armored electrical cable) conveyed drilling system including a drilling cuttings removal system which acts to remove and store cuttings displaced by a drill bit during drilling operations. The cuttings removal system may employ a screw member having a tapered lower portion and a narrow upper portion to transport drilling cuttings to a cuttings basket and distribute the cuttings therein. Embodiments of the drilling system include an integral tractor to move the wireline drilling system and to provide axial force (weight) on the drill bit, as well as assist in retrieval of the wireline drilling system if it should become stuck in a wellbore. The present disclosure relates to embodiments of such an integral tractor. While the present disclosure is made in terms of a tractor used in a wireline drilling system, it should be clearly understood that the scope of the present disclosure is not limited to wireline drilling systems.

Figure 1:
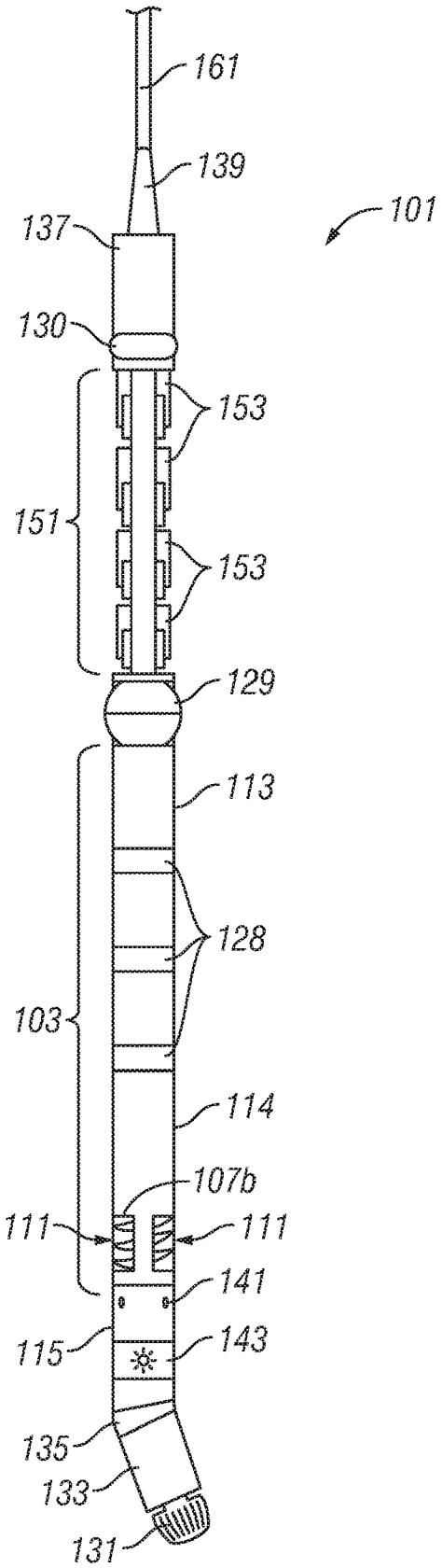
FIG. 1 shows an example embodiment of a well tool having a tractor according to the present disclosure.

The description following with reference to FIG. 1 is intended to show one example embodiment of a wellbore tool having a propulsion unit (tractor) according to the present disclosure. The embodiment shown in FIG. 1 may be similar to the wellbore tool disclosed in the '728 patent referenced above, and such embodiment as stated is provided herein only to show one possible use for a propulsion unit and wellbore tool according to the present disclosure. Referring to FIG. 1, an example embodiment of a wellbore tool such as a wireline-conveyed drilling system will be explained. The wireline drilling system 101 may comprise a cuttings removal system 103 which is similar to the cuttings removal system described in the '728 patent referenced above. In the present example embodiment an additional fluid inlet 112 is provided to permit additional borehole completion fluid or drilling fluid to be drawn into the wellbore tool by a pump 115, which in this embodiment may an impeller type pump, and a number of flexible portions 128 comprising rubber elastomers to provide the cuttings removal system 103 with a degree of articulation. This may be particularly useful for applications such as in deviated wellbores or when drilling open hole laterals from a parent or "pilot" wellbore where the wellbore tool is required to exhibit some flexibility.

Beneath the cuttings removal system 103 is located a drilling assembly comprising a drill bit 131 which is driven by a drill motor housed at 133. An adjustable bend 135 (or directional joint) may be provided to allow deviated drilling at a predetermined and/or controllable angle. The adjustable bend 135, for example, permits drilling of short radius laterals with very high dog leg sections. An electric motor (not shown) may control the orientation of the bend, and sensors provided to determine direction.

A first swivel or ball joint 129 may connect the cuttings removal system 103 to a propulsion unit or "tractor" 151 disposed above the first ball joint 129. The first ball joint 129 is intended to provide an articulation between the tractor 151 and the portions of the drilling system 101 below for flexibility and to rotationally decouple the tractor 151 and the cuttings removal system 103. The first ball joint 129, in combination with the articulated or flexible portions 128 and a second ball joint 130 above the tractor 151, allows for large deflections along the length of the drilling system 101. The tractor 151 will be further explained with reference to FIGS. 2 through 6.

The tractor 151 in this embodiment may be powered from the surface through electrical conductors in a wireline cable 161. Note that the wireline cable 161 in such embodiments is also the means by which the system 101 is lowered into the well bore and also how the wellbore tool (drilling system 101) may be deployed in a well and retrieved from such well. In this embodiment, the tractor 151 comprises one or more wheel sections 153 which may be configured to engage the wellbore once the drilling system 101 is in a desired position in the well.

Once engaged, the one or more wheel sections 153 are operated to progress the drilling system 101 downward and to provide weight-on-bit for drilling operations. The tractor 151 is able to operate at at least two speeds, for example with an adjustable displacement hydraulic motor; at least one quicker speed for rapidly progressing the drilling system 101 downhole and at least one lower speed for providing weight-on-bit.

Weight-on-bit provided by the tractor 151 may be supplemented by the weight of the drilling system 101 itself. Furthermore, should the drill bit become stuck, require to be picked off bottom, or drilling parameters varied, the tractor 151 can be reversed. Reverse operation of the tractor 151 can be supplemented by pulling on the wireline cable 161 from the surface. The tractor 151 may also serve the purpose of resisting reactive torque when the drilling system 101 is actively drilling subsurface formations.

Between the tractor 151 and a swivel 139 (for rotational decoupling between the wireline cable 161 and the drilling system 101) is located a control module 137 which houses control electronics. A number of sensors and sensor systems may also be provided within the wireline drilling system 101, in addition to the cuttings basket sensor (not shown—but described above), that provide information to the control module 137.

For example, a near-bit caliper sensor 141 may be provided beneath the cuttings removal system 103 to determine the diameter of the wellbore. In the present embodiment the caliper sensor 141 may be of the ultrasonic type, however it is with the scope of the present disclosure that a finger type sensor may be used, or any other suitable caliper. Note that the volume of the drilled wellbore can be determined based on the length of wireline cable 161 deployed (plus the length of the drilling system 101) and the diameter of the wellbore as determined by the caliper sensor. Comparison of the drilled wellbore volume and the amount of cuttings in the cuttings basket 109 may be used as a measure of hole cleaning efficiency.

An orientation sensor (not shown separately) may also be provided; in the present embodiment such sensor may be housed within the drilling motor housing 133. The orientation sensor may comprise a three-axis accelerometer to determine wellbore inclination with reference to gravity, although in other embodiments a gyroscope or similar sensor may be used. Wellbore direction, as well as tool orientation, can be derived from such measurements made in conjunction with measurements related to geodetic direction, such as multiaxial Earth magnetic field measurements.

Within the drilling motor housing 133 may be provided a rotational speed (RPM) sensor (not shown, to determine the rotational speed of the drill bit), a torque sensor (not shown, to determine the torque being applied to the drill bit) and a weight-on-bit (WOB) sensor (not shown, to determine the weight-on-bit). The RPM, torque and WOB measurements may be used to optimize drilling parameters.

An annular pressure sensor 143 may be provided to monitor the equivalent circulating density of the fluid circulating downhole. Equivalent circulating density, or ECD, is determined by dividing the detected annular pressure by the true vertical depth of the borehole. Changes in ECD may be related to changes in the amount of cuttings being recirculated. An additional benefit is that by monitoring ECD the risk of a stuck tool can be evaluated. For example, a larger than expected ECD may be indicative of cuttings beginning to pack off the wellbore and drilling parameters and/or fluid circulation can be altered to compensate.

The drilling system itself may comprise a large electric motor (housed in drilling motor module 133 and powered from the surface via the wireline cable) and a drilling bit 131, which may be any known drill bit, e.g., poly-crystalline diamond compact (PDC) type or diamond impregnated type.

Figure 2:
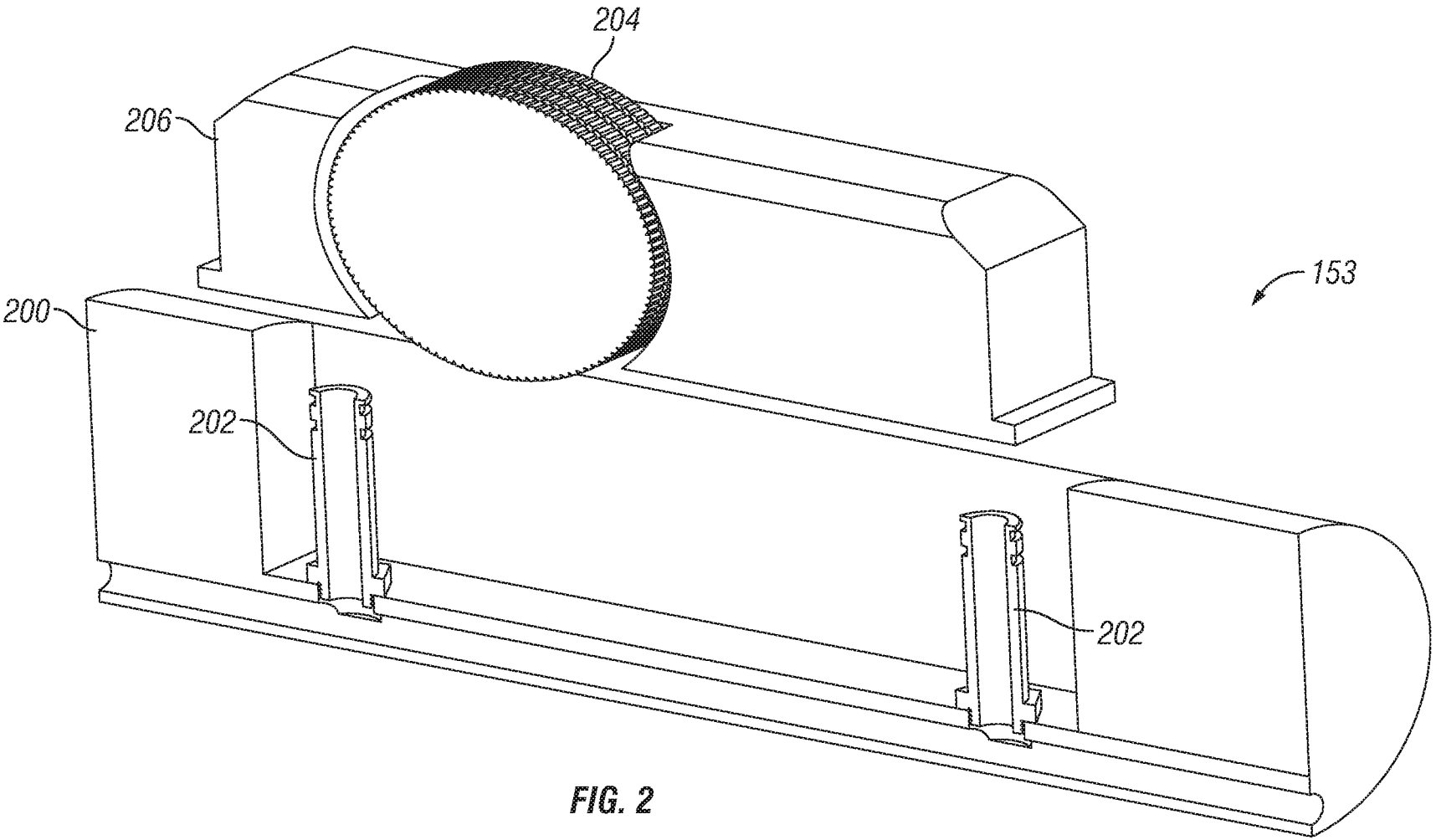
FIG. 2 shows an oblique view of some components of a wheel section of the well tractor shown in FIG. 1.

A wheel section of the tractor (151 in FIG. 1) may be better understood with reference to FIGS. 2 through 6. FIG. 2 shows general details of a wheel section 153 according to the present disclosure. A tractor pad 206 may be mounted on a tractor housing 200, for example, on fixed pistons 202. The tractor housing 200 may be coupled within the tractor (151 in FIG. 1) in any manner known in the art. For example, the tractor housing 200 may form part of or may be coupled to the cuttings removal system (103 in FIG. 1) or may be part of a plurality of wheel sections such as shown in FIG. 1. The wheel section 153 may be fixedly or rotationally coupled within the drilling system (101 in FIG. 1) using swivels (129, 130 as shown in FIG. 1). The manner of coupling the one or more wheel sections 153 to the wellbore tool as explained with reference to FIG. 1 is not intended to limit the scope of the present disclosure. The tractor pad 206 in the present embodiment is mounted to the tractor housing 200 so that the tractor pad 206 can be laterally extended from and laterally retracted toward the tractor housing 200. Such lateral extension and retraction may be provided to enable the wheel section 153 to be operated to move the wellbore tool (e.g., drilling system 101 in FIG. 1) or to enable relatively unimpeded movement of the wellbore tool such as by extending or retracting the wireline cable (161 in FIG. 1). In the present example embodiment, the tractor pad 206 may be extended and retracted by applying hydraulic fluid pressure to one or the other side of a fluid chamber defined within a respective cylinder (see 203 in FIG. 3) by the fixed pistons 202. A drive wheel 204 may be rotatably mounted on the tractor housing 206. When the tractor pad 206 is extended from the tractor housing 200, the drive wheel 204 is urged into contact with the wall of the wellbore. It will be appreciated by those skilled in the art that such urging will correspondingly displace the wellbore tool, (e.g., drilling system 101 in FIG. 1) toward the opposed side of the wellbore wall, and that in practical implementations of a tractor according to the present disclosure a device to enable relatively unimpeded longitudinal movement of the wellbore tool such as a wheel or the like may be provided on the side of the wellbore tool opposed to the drive wheel 204. The particular implementation of such wheel or the like is not intended to limit the scope of the present disclosure.

Figure 3:
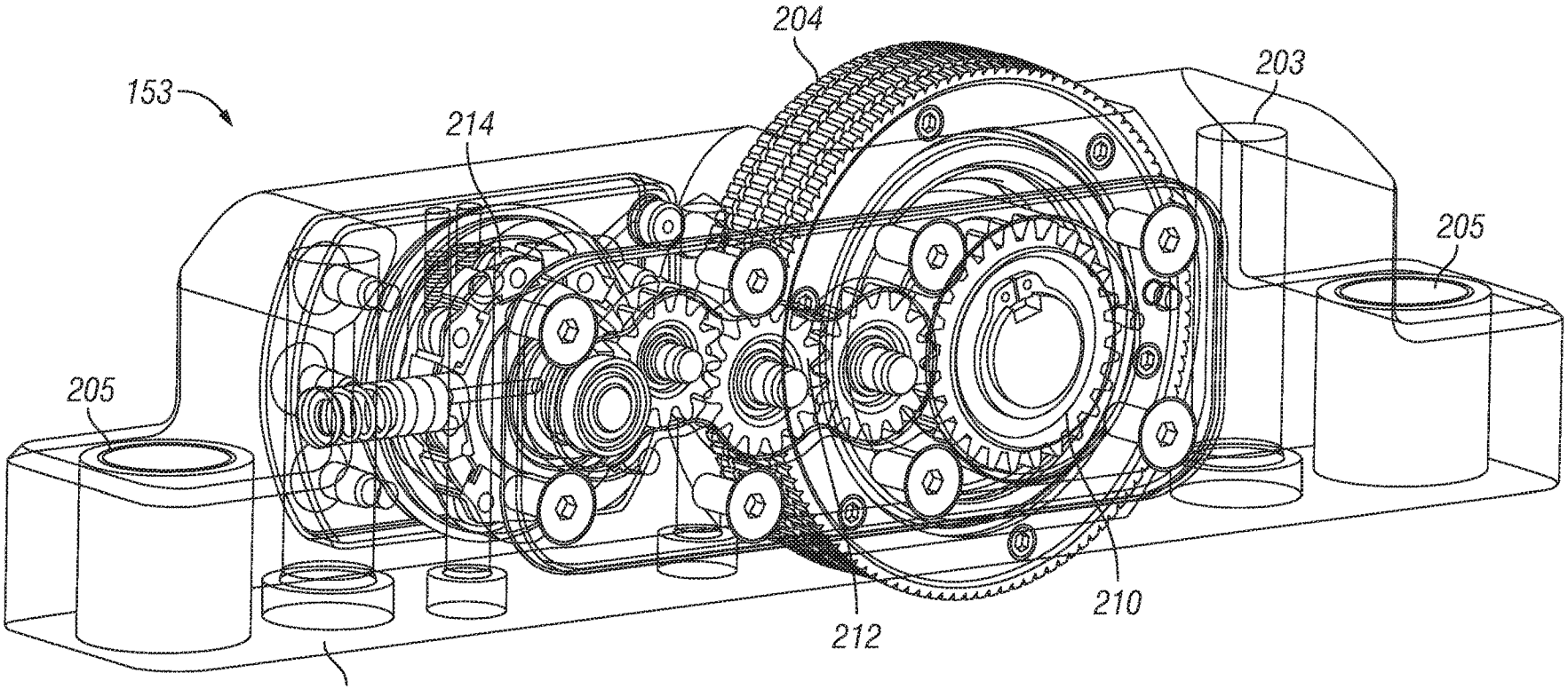
FIG. 3 shows a cut away view of the example embodiment of the wheel section of a well tractor shown in FIG. 2.

FIG. 3 shows an internal view of functional components of the wheel section 153 and the tractor pad 206. As explained above, the tractor pad 206 may comprise hydraulic cylinders 203 to engage respective ones of the fixed pistons (202 in FIG. 2). In some embodiments, guide bushings 205 may be provided to slidingly engage corresponding guide pins (not shown) in the tractor housing (200 in FIG. 2). A variable displacement hydraulic motor 214 may be formed into a suitable pocket in the tractor pad 206. The variable displacement hydraulic motor 214 will be further explained with reference to FIG. 6. Rotational output of the variable displacement hydraulic motor 214 may be coupled through a gear set 212 to the drive wheel 204, for example, through an output gear 210. The drive wheel 204 may be rotatably mounted to the tractor pad 206 by any suitable bearing or bearings.

Figure 4:
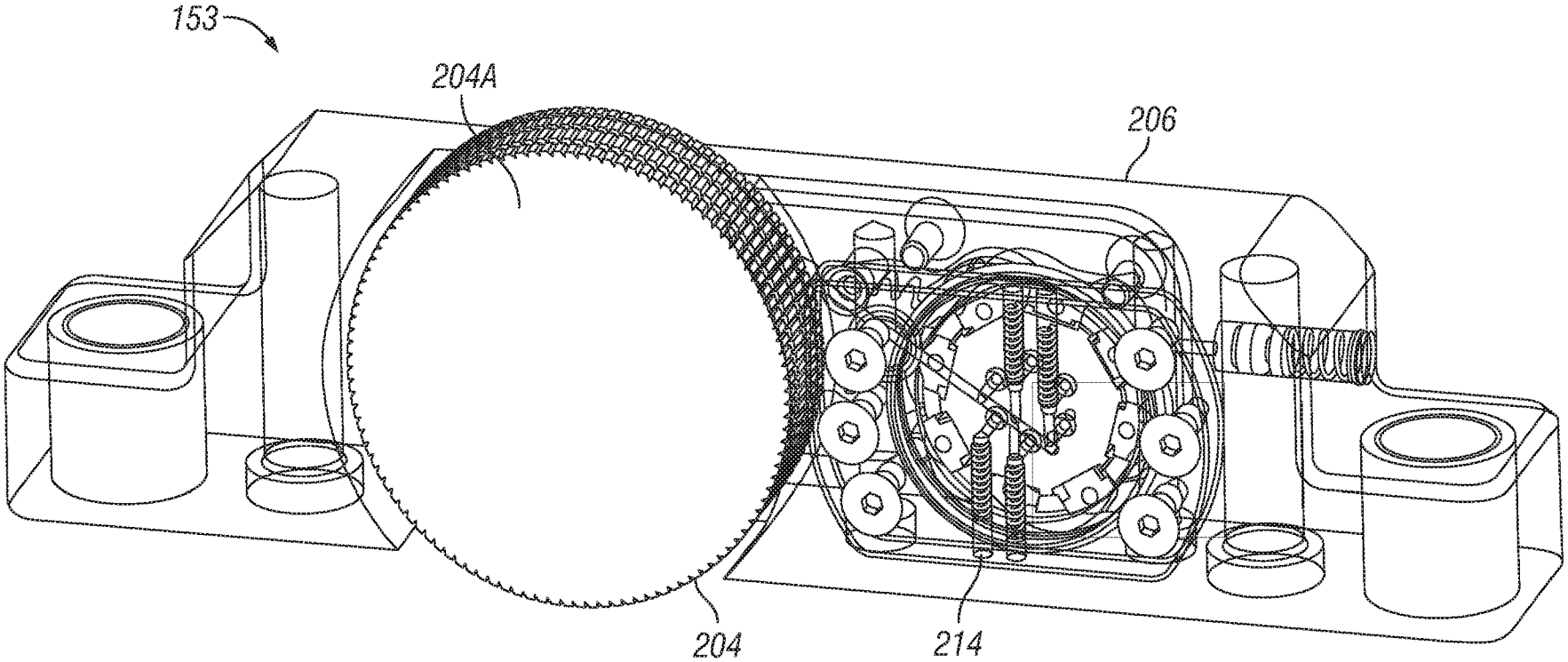
FIG. 4 shows an opposed oblique view of the wheel section shown in FIG. 3.

FIG. 4 shows a view of the wheel section 153 in opposed perspective to the view in FIG. 3, such that a closed face 204A of the drive wheel 204 may be observed. By having a closed face, the drive wheel 204 may be mounted to the tractor pad 206 to improve exclusion of well fluids and solids from entering the rotatable mounting of the drive wheel 204 onto the tractor pad 206.

Figure 5:
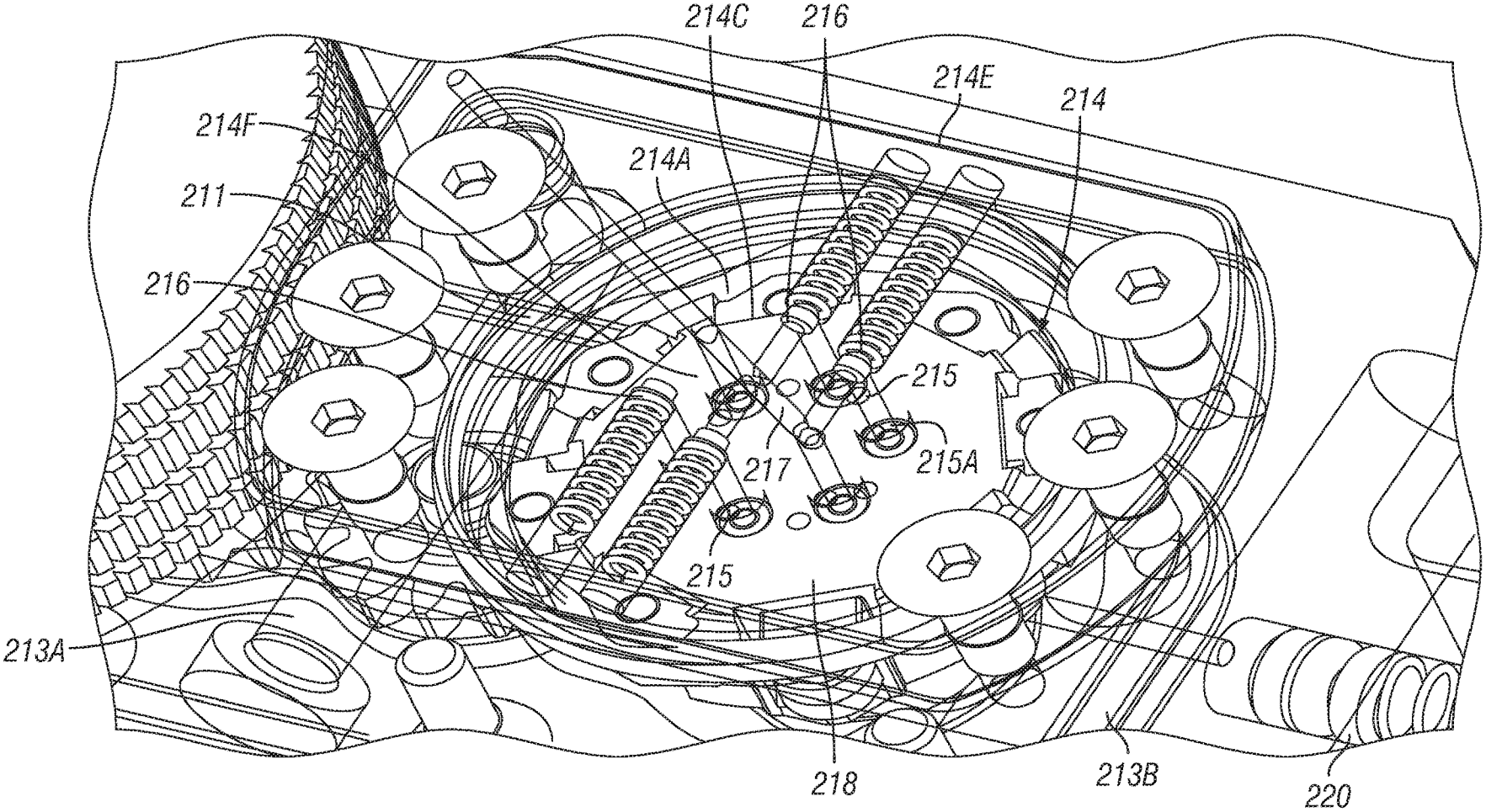
FIG. 5 shows an enlarged view of a variable displacement hydraulic motor in the wheel section of FIGS. 2, 3 and 4.

FIG. 5 shows a view of the variable displacement hydraulic motor 214. The motor 214 may be disposed in a pocket or cavity 214A. The cavity 214A may be formed in the tractor pad 206. A rotor 214F may be disposed within the cavity 214A. A plurality of radially displaceable pistons 214C may be disposed in respective bores (214B in FIG. 6) formed in the rotor 214F. The cavity 214A and rotor 214F may be closed by a cover plate 214E. The cover plate 214E may comprise hydraulic fluid passages 213 to enable hydraulic fluid to move through displacement chambers defined by the cavity 214A and the radially displaceable pistons 214C such that movement of hydraulic fluid causes corresponding rotation of the rotor 214F.

Figure 6:
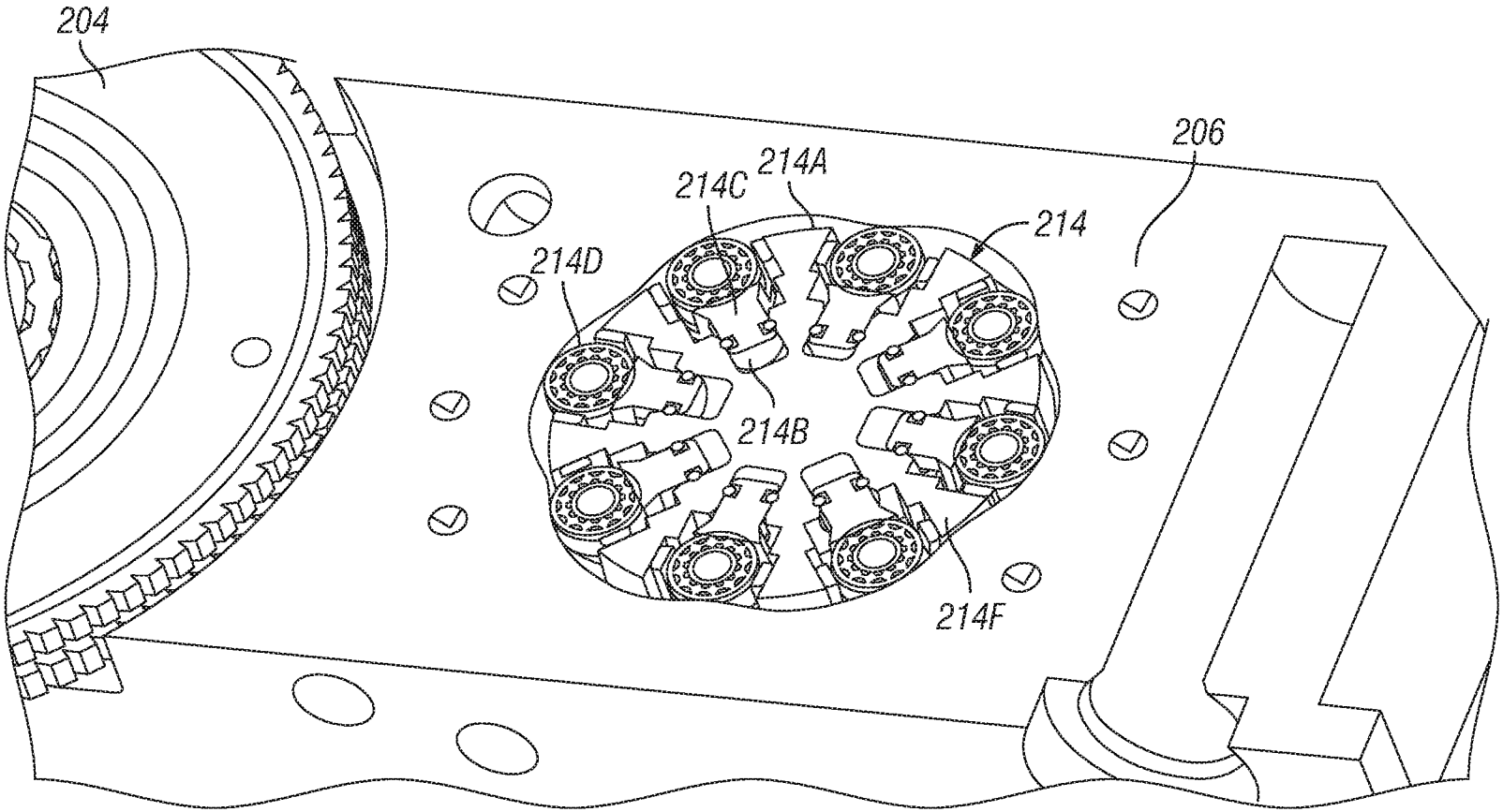
FIG. 6 shows an opposed view of the variable displacement hydraulic motor shown in FIG. 5.

To obtain variable displacement, and referring to FIG. 6, each radially displaceable piston 214C may be disposed in a corresponding bore 214B in the rotor 214F. When urged outwardly by hydraulic fluid pressure in the corresponding bores 214B, the radially displaceable pistons 214C are urged radially outwardly so that corresponding rollers 214D may contact the interior wall of the cavity 214A. The interior wall of the cavity 214A may be shaped to define displacement chambers whereby hydraulic fluid under pressure may urge the rotor 214F to rotate within the cavity 214A. To change the displacement of the variable displacement motor 214, selected ones of the radially displaceable pistons 214C may have their respective bores 214B depressurized so that the corresponding radially displaceable pistons 214C are not urged into contact with the interior wall of the cavity 214A. Thus, selected ones of the radially displaceable pistons 214C do not define displacement volume about the rotor 214F. In this way, the rotational speed and torque of the motor 214 may be selected by the system operator or automatically.

Referring back to FIG. 5, hydraulic fluid under pressure may be provided to operate the motor 214 through fluid supply 213A and return 213B ports. Such fluid supply 213A and return 2138 may direct hydraulic fluid flow into the interior of the cavity (214A in FIG. 6) to cause corresponding rotation of the rotor (214F in FIG. 5). Hydraulic fluid may be provided to the radially displaceable pistons (see 214C in FIG. 6) through a main supply passage 211 that may branch to one or more piston control port 215. Each piston control port 215 may comprise a pressure relief valve 216 that opens at a predetermined hydraulic fluid pressure. In the present example embodiment, such predetermined pressure may be 3 ksi. When the hydraulic fluid pressure reaches the predetermined pressure, the relief valve(s) 216 may open, enabling hydraulic fluid to flow through corresponding ports 215A on a distribution plug 218 and then to one or more of the radially displaceable pistons (214C in FIG. 6). In the present example embodiment, one or more piston operating ports 217 may conduct hydraulic fluid to one or more of the radially displaceable pistons (241C in FIG. 6) when hydraulic fluid is supplied to the motor 214 even below the predetermined pressure. In combination, the piston control ports 215, pressure relief valves 216 and piston operating ports 217 may provide the following functionality to the motor 214. At pressure below the predetermined pressure, hydraulic fluid urges one or more of the radially displaceable pistons (214C in FIG. 6) into contact with the wall of the cavity (214A in FIG. 6). In such configuration, another of the at least one of the radially displaceable pistons (214C in FIG. 6) is not urged into such contact, and therefore does not affect displacement of the motor 214. Hydraulic fluid may flow into and out of the cavity (214A in FIG. 6) to cause the motor 214 to turn at a first speed and to generate a first torque. When the hydraulic fluid pressure exceeds the predetermined pressure, one or more of the pressure relief valves 216 may open, causing one or more of the radially displaceable pistons not already urged outwardly to be urged into contact with the wall of the cavity (214A in FIG. 6), thereby increasing displacement of the motor 214. Increasing the displacement of the motor 214 will, for any hydraulic fluid pressure and flow rate, cause the motor to turn at a second speed slower than the first speed and to generate a second torque greater than the first torque.

In the present example embodiment, hydraulic fluid pressure may be maintained relative to ambient fluid pressure in a well through a pressure compensator 220. The pressure compensator 220 may be a spring loaded piston or similar device that can freely transmit well fluid pressure (ambient pressure) to the hydraulic fluid.

Figure 7:
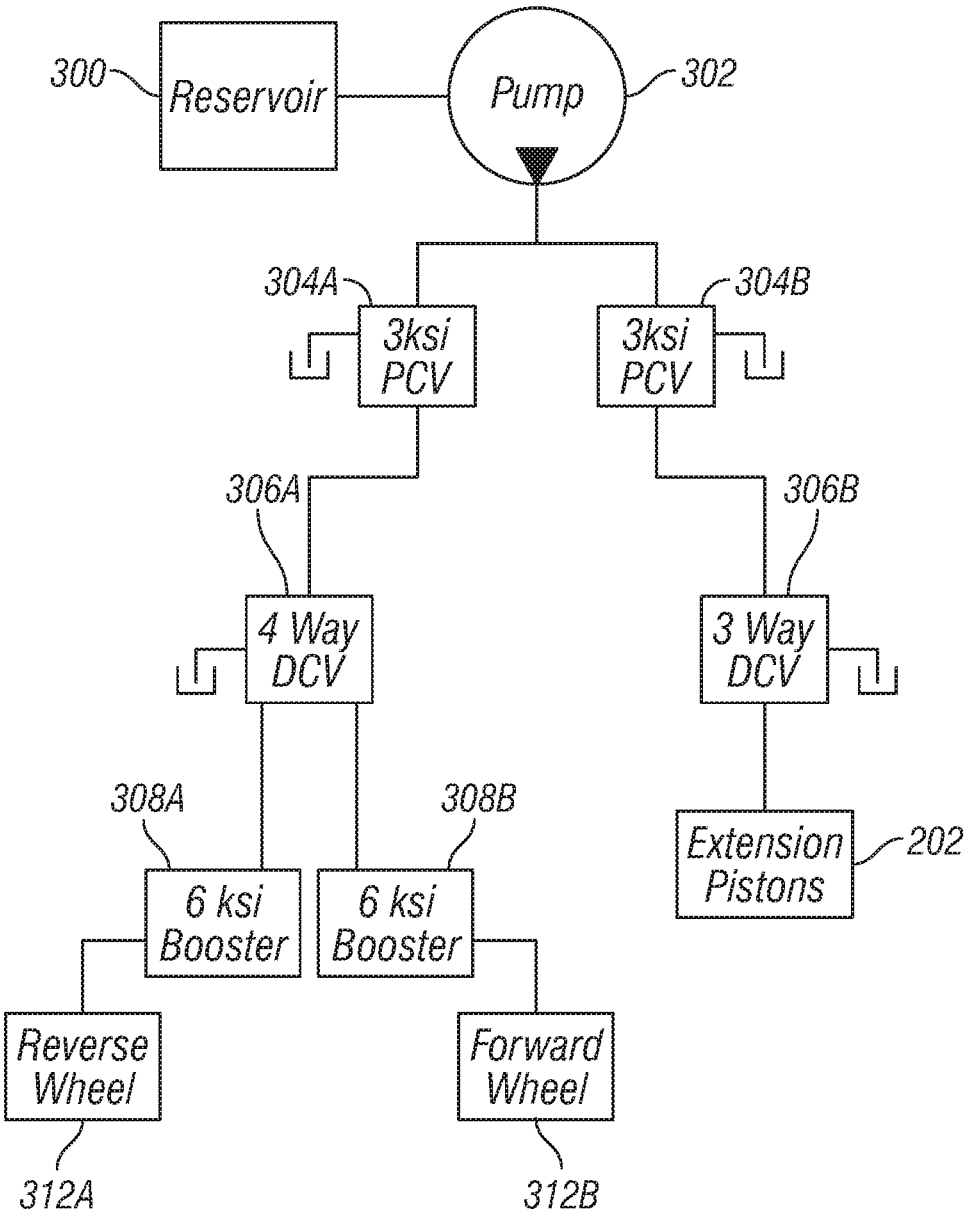
FIG. 7 shows a schematic diagram of an example embodiment of an hydraulic fluid circuit for a tractor.

FIG. 7 shows a schematic diagram of an example embodiment of an hydraulic system that may be used in accordance with the present disclosure. Hydraulic fluid may be obtained from a reservoir 300 from which a pump 302 withdraws hydraulic fluid and discharges it under pressure. The reservoir 300 may be pressure compensated so as to be at a same pressure as fluid in a wellbore in which the drilling system (101 in FIG. 1) is disposed. The reservoir 300 and the pump 302 may be disposed in any convenient place in the drilling system (101 in FIG. 1); in some embodiments, the reservoir 300 and the pump 302 may be disposed in the tractor housing (200 in FIG. 2). Discharge from the pump 302 may be directed to one or more pressure relief or pressure control valves 304A, 304B so as to maintain the hydraulic fluid at a predetermined pressure above the ambient pressure. Although two pressure relief valves 304A, 304B are shown in FIG. 7, other embodiments may use more or fewer such relief valves, or may use one or more pressure regulators of any type known in the art. Hydraulic fluid from the second pressure relief valve 304B may be directed to a second control valve 306B. The second control valve 306B may selectively direct hydraulic fluid under pressure to the fixed pistons (202 in FIG. 2) to extend or retract the tractor pad (206 in FIG. 2) from the tractor housing (200 in FIG. 2).

Hydraulic fluid discharged from the first pressure relief valve 304A may be directed to a second control valve 306A. In embodiments wherein the pump 302 and the reservoir 300 are disposed in the drilling system (101 in FIG. 1) apart from the tractor pad (206 in FIG. 2), conduits for hydraulic fluid may be formed, for example, within the guide bushings (205 in FIG. 2) and/or the fixed pistons (202 in FIG. 2). In some embodiments, the second control valve 306A may selectively direct hydraulic fluid to one or more hydraulic pressure intensifiers (microboosters) 308A, 308B. Non-limiting example embodiments of such hydraulic pressure intensifiers are sold by miniBOOSTER A/S, Fynsgade 3, DK—6400 Sønderborg, Denmark. The one or more microboosters 308A, 308 may be selectively operable to increase pressure of the hydraulic fluid from a first pressure, e.g., 3 ksi to a second, higher pressure, e.g., 6 ksi. As explained with reference to FIG. 5, when the relevant microbooster is operated to maintain hydraulic fluid pressure at the first pressure, hydraulic fluid will operate an associated motor (214 in FIG. 5) 312A, 312B at the first rotational speed and first torque. When the relevant microbooster is operated to increase hydraulic fluid pressure to the second pressure, the associated motor (214 in FIG. 5) may be operated to increase its displacement, thereby operating the associated motor (214 in FIG. 5) 312A, 312B at the second speed and second torque. In the embodiment shown in FIG. 7, there may be at least one wheel section (153 in FIG. 1) operable to move the drilling system (101 in FIG. 1) in one direction along a well, and at least one reverse wheel section (153 in FIG. 1) operable to move the drilling system in the opposite direction. Having one wheel section and a reverse wheel section may avoid the need to provide any one or more wheel sections with reversible fluid flow through the associated motor (214 in FIG. 5).

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A propulsion unit for a wellbore tool, comprising:

a tool body;

at least one wheel section disposed along the tool body, the at least one wheel section comprising a tractor pad movably coupled to a tractor housing coupled to the tool body, the tractor pad movable only in a lateral direction with respect to the tool body, a wheel rotatably supported in the tractor pad so as to contact a wall of a wellbore when the tractor pad is moved away from the tractor housing and an hydraulic motor rotationally coupled to the wheel;

wherein the hydraulic motor comprises a plurality of circumferentially spaced apart, radially displaceable pistons each disposed in a respective radially extending cylinder formed in a rotor, the rotor rotatably disposed in a cavity, for at least one of the radially displaceable pistons a part of the respective cylinder between the at least one of the radially displaceable pistons and the rotor connected by a valve to a source of hydraulic pressure to enable selected connection of hydraulic pressure to the part of the respective cylinder, a corresponding part of the respective cylinder in at least one of a remainder of the radially displaceable pistons connected at all times to the source of hydraulic pressure and remaining pressurized at all times, whereby displacement chambers defined between the rotor and an interior wall of the cavity change in size, thereby changing a displacement of the hydraulic motor; and means for moving the tractor pad between an extended position and a retracted position.

2. The propulsion unit of claim 1 wherein the valve comprises a pressure relief valve disposed in a hydraulic fluid supply conduit in communication with the at least one radially displaceable piston, wherein fluid communication to the part of the respective cylinder of the at least one of the radially displaceable pistons is open when hydraulic pressure exceeds an operating pressure of the pressure relief valve.

3. The propulsion unit of claim 2 further comprising an hydraulic pressure intensifier disposed in the hydraulic fluid supply conduit and arranged to selectively increase the hydraulic pressure to above the operating pressure.

4. The propulsion unit of claim 1 wherein the means for moving the tractor pad comprises at least one fixed piston disposed on the tractor housing and extending into a cylinder formed in the tractor pad.

5. The propulsion unit of claim 1 further comprising at least one guide bushing disposed in the tractor pad arranged to engage a corresponding guide pin in the tractor housing.

6. The propulsion unit of claim 1 wherein the wellbore tool comprises a drilling system.

7. The propulsion unit of claim 6 wherein the drilling system comprises a drilling cuttings removal system.

8. The propulsion unit of claim 1 wherein the wellbore tool is connected to a wireline cable.

9. A method for moving a wellbore tool, comprising:

extending a tractor pad laterally from the wellbore tool to urge a wheel rotatably supported on the tractor pad into contact with a wall of the wellbore;

pumping hydraulic fluid at a first pressure into displacement chambers defined between a rotor and an interior wall of a cavity of a hydraulic motor disposed in the tractor pad and rotationally coupled to the wheel, the hydraulic motor comprising a plurality of circumferentially spaced apart, radially displaceable pistons each disposed in respective radially extending cylinders formed in the rotor, the rotor rotatably disposed in a cavity, for at least one of the radially displaceable pistons a part of the respective cylinder between the at least one piston and the rotor connected by a valve to a source of hydraulic pressure, a corresponding part of the respective cylinder in at least one of a remainder of the pistons connected at all times to the source of hydraulic pressure to remain pressurized at all times; and increasing pressure of the hydraulic fluid between a position of the pumping and the hydraulic motor to above a predetermined value to operate the valve to increase a displacement of the hydraulic motor by urging the at least one of the radially displaceable pistons into contact with the interior wall of the cavity so as to decrease a speed of the motor and increase a torque of the motor.

10. The method of claim 9 wherein the extending the tractor pad is performed only in a direction laterally outward from the wellbore tool.

* * * * *